US007292706B2

(12) United States Patent
Hamada

(10) Patent No.: US 7,292,706 B2
(45) Date of Patent: Nov. 6, 2007

(54) SUPPORT STRUCTURE OF LOUDSPEAKER UNIT AND LOUDSPEAKER SYSTEM

(75) Inventor: Kazuhiko Hamada, Kobe (JP)

(73) Assignee: Fujitsu Ten Limited, Hyogo (JP)

( * ) Notice: Subject to any disclaimer, the term of this patent is extended or adjusted under 35 U.S.C. 154(b) by 608 days.

(21) Appl. No.: 10/802,767

(22) Filed: Mar. 18, 2004

(65) Prior Publication Data

US 2004/0208336 A1 Oct. 21, 2004

(30) Foreign Application Priority Data

Mar. 19, 2003 (JP) ..... 2003-075515

(51) Int. Cl.
*H04R 25/00* (2006.01)

(52) U.S. Cl. ..... 381/386; 381/87; 381/395

(58) Field of Classification Search ..... 381/89, 381/332, 345, 346, 352–354, 182, 186, 386; 181/144, 145, 147, 150, 161, 198, 199
See application file for complete search history.

(56) References Cited

U.S. PATENT DOCUMENTS 3,393,764 A * 7/1968 Schafer ..... 381/89
4,939,783 A * 7/1990 Dunning ..... 381/386
6,804,365 B2 * 10/2004 Ohira et al. ..... 381/386

FOREIGN PATENT DOCUMENTS

JP 11-146471 5/1999
JP 11-146472 5/1999
JP 11-289588 10/1999
JP 11-355876 12/1999
JP 2001-078285 3/2001
JP 2001-224089 8/2001
JP 2001-285974 10/2001
JP 2001-352591 12/2001
JP 2001-352592 12/2001
JP 2002-152884 5/2002
JP 2002-247675 8/2002
JP 2004-009924 1/2004
JP 2004-015565 1/2004
JP 2004-015566 1/2004

* cited by examiner

*Primary Examiner*—Huyen Le
(74) *Attorney, Agent, or Firm*—Wenderoth, Lind & Ponack, L.L.P.

(57) ABSTRACT

A support structure of a loudspeaker unit is constructed to prevent transmission of vibrations of the loudspeaker unit to a cabinet so that the quality of sound can be improved, and so as to have excellent stability in its assembled condition. The support structure includes a cabinet having an opening in which the front side of the loudspeaker unit is located, an anchor to be connected to the backside of the loudspeaker unit, a support for supporting the anchor so that the center of gravity of the anchor inside the cabinet is fixed, and a positioning member for positioning the support. The support structure also includes a cushioning member that is fitted between the support and the positioning member.

20 Claims, 5 Drawing Sheets

SUPPORT STRUCTURE OF LOUDSPEAKER UNIT AND LOUDSPEAKER SYSTEM

BACKGROUND OF THE INVENTION

1. Field of the Invention

The present invention relates to a support structure of a loudspeaker unit and a loudspeaker system. More particularly, the present invention relates to a support structure of a loudspeaker unit enabling a construction in which vibrations of the loudspeaker unit are prevented from being transmitted to a loudspeaker cabinet so that the quality of sound can be improved, and a loudspeaker system.

2. Description of the Relevant Art

FIG. 5 is a sectional side view schematically showing a conventional loudspeaker system.

A loudspeaker system 50 comprises a loudspeaker unit 60 consisting of a cone 61, a voice coil 62, a magnetic circuit 63, a frame 64 and associated parts, and a box-shaped loudspeaker cabinet (hereinafter, simply referred to as the cabinet) 70 in which the loudspeaker unit 60 is assembled. The outer region of the frame 64 of the loudspeaker unit 60 is fastened to the rim of an opening 71 at the front of the cabinet 70 by using screws 72.

In such loudspeaker system 50, since the loudspeaker unit 60 is directly fastened to the cabinet 70, the mounted condition of the loudspeaker unit 60 on the cabinet 70 is stable. As a result, even if the cabinet 70 is caused to tilt or topple over, the loudspeaker unit 60 is unlikely to come off the cabinet 70. In addition, the orientation of its installation (such as a portrait or landscape orientation) and the like can be changed to suit the preferences of a user.

However, while the loudspeaker unit 60 is driven, vibrations of the cone 61 are directly transmitted through the frame 64 to the front of the cabinet 70, so that the whole of the cabinet 70 vibrates. That creates undesired sounds (sounds which do not pertain to original signals), which cause degradation of the quality of sound (e.g. unclearness of sound).

In order to solve the above problem, for example, a loudspeaker system described in the Japanese Kokai No. 1999-355876 has been proposed. FIG. 6 is a sectional side view schematically showing the loudspeaker system disclosed in this publication.

A loudspeaker system 50A comprises a cabinet 70A having an opening 71A at the front thereof for allowing a loudspeaker unit 60A to be exposed, a column 73 extended upwardly from the center portion of the inside bottom of the cabinet 70A, a balance member 74 having a shaft 74*a* supported by a pivot 73*a* on the top of the column 73 with a balance construction, a weight 75 fixed for balancing with the loudspeaker unit 60A in the position opposite to the loudspeaker unit 60A with the balance member 74 therebetween, and an elastic body 76 fitted between the opening 71A of the cabinet 70A and the loudspeaker unit 60A.

Using such loudspeaker system 50A, vibrations originating from the loudspeaker unit 60A are absorbed by pendulous movements of the balance member 74, and the energy of vibrations unsuccessfully absorbed thereby is transmitted from the balance member 74 to the column 73 so as to be grounded. As a result, it is possible to prevent unclearness of sound from being caused by the vibrations during operation of the loudspeaker unit 60A being transmitted to the cabinet 70A.

However, the loudspeaker system 50A described in the above publication has such an unstable support structure comprising the column 73 and the balance member 74, so that when the cabinet 70A is caused to tilt or topple over, the shaft 74*a* of the balance member 74 is likely to come off the pivot 73*a* of the column 73. As a result, there is a possibility that the loudspeaker unit 60A will come off the opening 71A and be unable to be arranged in its original position. Furthermore, there is a possibility that its internal wiring will be broken, or that the loudspeaker unit 60A itself will be broken. The mounted condition of the loudspeaker unit 60A is less stable, and the orientation of installation of the cabinet 70A cannot be changed.

SUMMARY OF THE INVENTION

The present invention was accomplished in order to solve the above problems with the conventional loudspeaker systems. Accordingly, an object of the present invention is to provide a support structure of a loudspeaker unit which prevents transmission of vibrations of the loudspeaker unit to a cabinet so that the quality of sound can be improved, and which has excellent stability in its assembled condition, and a loudspeaker system.

In order to achieve the above object, a support structure of a loudspeaker unit according to a first aspect of the present invention is characterized by comprising a loudspeaker cabinet having an opening in which the front side of a loudspeaker unit is located, an anchor member to be connected to the backside of the loudspeaker unit, a supporting member for supporting the anchor member inside the loudspeaker cabinet, and a positioning member for positioning the supporting member, wherein a cushioning member is fitted between the supporting member and the positioning member, and/or between the anchor member and the supporting member.

In the support structure of a loudspeaker unit according to the first aspect of the present invention, the supporting member is positioned by the positioning member, the anchor member is supported by the positioned supporting member inside the loudspeaker cabinet, and the cushioning member is fitted between the supporting member and the positioning member, and/or between the anchor member and the supporting member. Therefore, the loudspeaker unit connected to the anchor member is arranged in a floating state in a prescribed position inside the loudspeaker cabinet. As a result, vibrations transmitted from the loudspeaker unit to the anchor member are not transmitted to the loudspeaker cabinet, so that it is possible to prevent degradation of the quality of sound caused by vibrations of the loudspeaker cabinet.

By setting the weight of the anchor member to be heavier than that of the loudspeaker unit, it is possible to allow the anchor member to function as a virtual ground. As a result, the effect of suppressing the vibrations of the loudspeaker unit can be further enhanced.

Furthermore, even if the installed condition of the loudspeaker cabinet is changed (for example, even if tilting, toppling or the like occurs), the mounted position of the loudspeaker unit is not changed since the anchor member can be supported by the supporting member in such a manner that the center of gravity of the anchor member does not change, resulting in a construction having excellent stability in its assembled condition. Also, it is possible to freely change the orientation of installation of the loudspeaker cabinet such as into either a portrait or landscape orientation, and the structure is easily applied to not only loudspeaker cabinets for home use but also those for vehicles or the like.

A support structure of a loudspeaker unit according to a second aspect of the present invention is characterized by the anchor member which comprises a first anchor member and a second anchor member, the first anchor member and the second anchor member being coupled in the support structure of a loudspeaker unit according to the first aspect of the present invention.

In the support structure of a loudspeaker unit according to the second aspect of the present invention, the first anchor member and the second anchor member can be separately assembled into the loudspeaker cabinet and be coupled using screws or the like thereafter. As a result, the process of assembling the anchor member into the loudspeaker cabinet is easy to carry out, resulting in an improvement in workability of the assembling process.

A support structure of a loudspeaker unit according to a third aspect of the present invention is characterized by the supporting member which comprises multiple supports radially arranged from the anchor member in the support structure of a loudspeaker unit according to the first or second aspect of the present invention.

In the support structure of a loudspeaker unit according to the third aspect of the present invention, since the supporting member comprises multiple supports arranged in a radial manner from the anchor member, the anchor member is stably supported through the interaction between the multiple supports even if the installed condition of the loudspeaker cabinet is changed by tilting, toppling or the like. As a result, it is possible to reliably prevent the occurrence of a position change of the anchor member and to support the loudspeaker unit connected to the anchor member in its stable state inside the loudspeaker cabinet.

A support structure of a loudspeaker unit according to a fourth aspect of the present invention is characterized by the positioning member which has a fitting portion into which the tip portion of the supporting member is fitted in the support structure of a loudspeaker unit according to any of the first through third aspects of the present invention.

In the support structure of a loudspeaker unit according to the fourth aspect of the present invention, it is possible to prevent the occurrence of a displacement of the tip portion of the supporting member caused by tilting or toppling of the loudspeaker cabinet, shaking in transmit or the like, and to support the loudspeaker unit connected to the anchor member in its stable state inside the loudspeaker cabinet.

A support structure of a loudspeaker unit according to a fifth aspect of the present invention is characterized by a cushioning member which is fitted between the opening of the loudspeaker cabinet and the loudspeaker unit in the support structure of a loudspeaker unit according to any of the first through fourth aspects of the present invention.

Using the support structure of a loudspeaker unit according to the fifth aspect of the present invention, it is possible to maintain an airtight state inside the loudspeaker cabinet with the cushioning member, and to hold the loudspeaker unit in a floating state relative to the front of the loudspeaker cabinet. As a result, it is possible to prevent transmission of vibrations from the loudspeaker unit to the front of the loudspeaker cabinet, resulting in prevention of degradation of the quality of sound caused by undesired vibrations of the loudspeaker cabinet.

A first loudspeaker system arrangement according to the present invention is characterized by multiple sets of the support structure of a loudspeaker unit according to any of the first through fifth aspects of the present invention being arranged within the loudspeaker cabinet.

In the first loudspeaker system arrangement according to the present invention, the support structure of a loudspeaker unit can be adopted in a multi-way loudspeaker system wherein two or more loudspeaker units are contained in one loudspeaker cabinet. It is possible to hold each loudspeaker unit in a floating state thereby, resulting in prevention of degradation of the quality of sound. And the system can be given a stable construction in which no displacement of each loudspeaker unit or the like is caused even by tilting, toppling or the like.

A second loudspeaker system arrangement according to the present invention is characterized by being a loudspeaker system, wherein the support structure of a loudspeaker unit according to any of the first through fifth aspects of the present invention is adopted, comprising a first loudspeaker unit and a second loudspeaker unit connected back to back through the anchor member, and wherein the first loudspeaker unit and the second loudspeaker unit have the same signals supplied thereto in phase with each other.

In the second loudspeaker system arrangement according to the present invention, since the first loudspeaker unit and the second loudspeaker unit connected back to back to each other through the anchor member are operated in phase with each other, vibrations transmitted from both the loudspeaker units are canceled out in the anchor member, so that the effect of suppressing the vibrations transmitted from the loudspeaker units can be further enhanced.

A third loudspeaker system arrangement according to the present invention is characterized by being a loudspeaker system, wherein the support structure of a loudspeaker unit according to any of the first through fifth aspects of the present invention is adopted, comprising a first loudspeaker unit and a second loudspeaker unit connected back to back through the anchor member, wherein the first loudspeaker unit and the second loudspeaker unit have the same signals supplied thereto in opposite phase to each other.

In the third loudspeaker system arrangement according to the present invention, since the first loudspeaker unit and the second loudspeaker unit connected back to back to each other through the anchor member are operated in opposite phase, the system can be given a construction in which no change in pressure is apparently brought about inside the loudspeaker cabinet. As a result, since the internal pressure does not vary, it is possible to make the response characteristics of diaphragms of the loudspeaker units better, so that the quality of sound can be further improved. And because of no change in internal pressure, it is possible to make the loudspeaker cabinet smaller.

DESCRIPTION OF THE PREFERRED EMBODIMENTS

Figure 1:
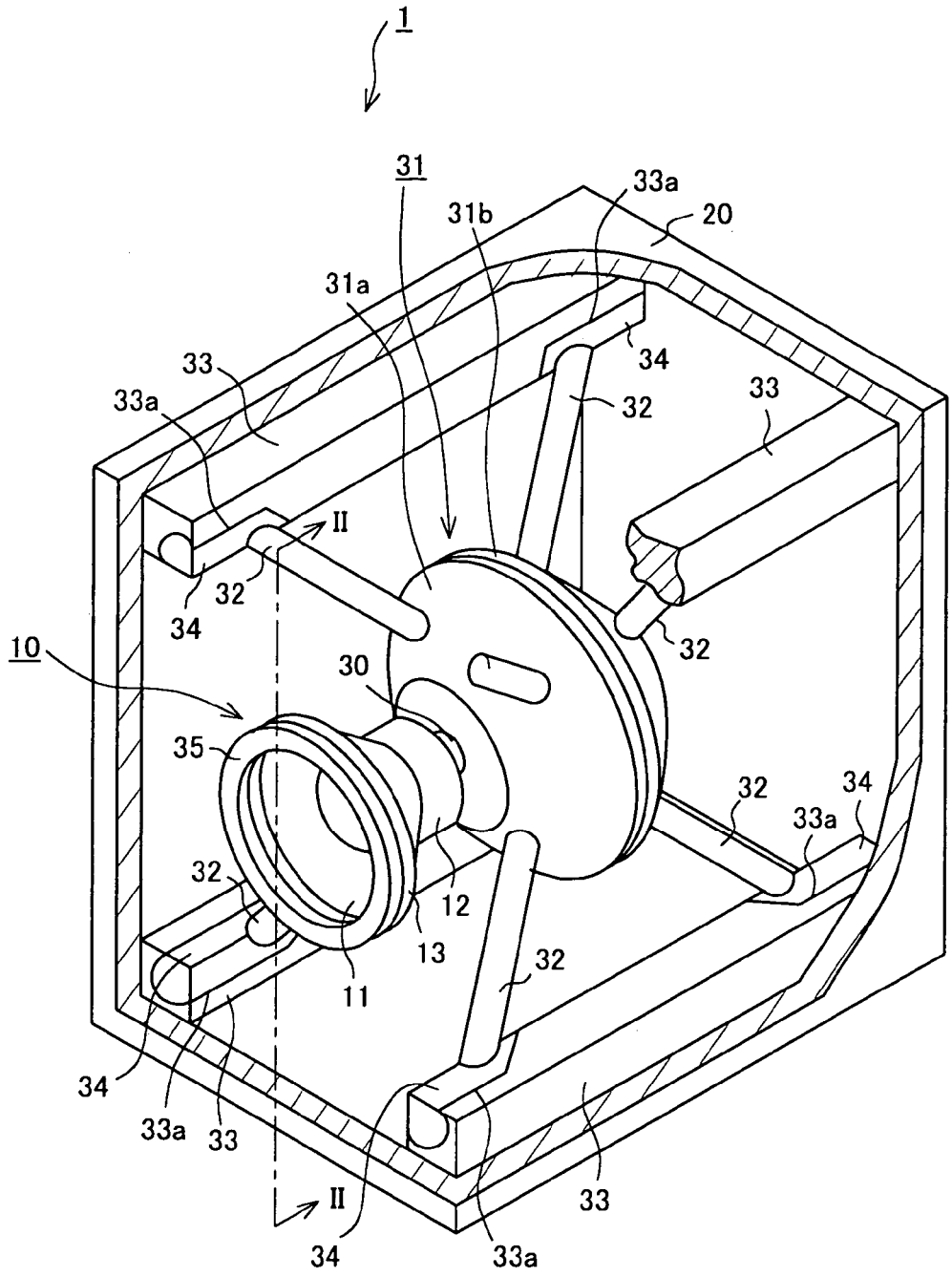
FIG. 1 is a partly sectional perspective view schematically showing a loudspeaker system in which a support structure of a loudspeaker unit according to a first embodiment of the present invention is adopted.
Figure 2:
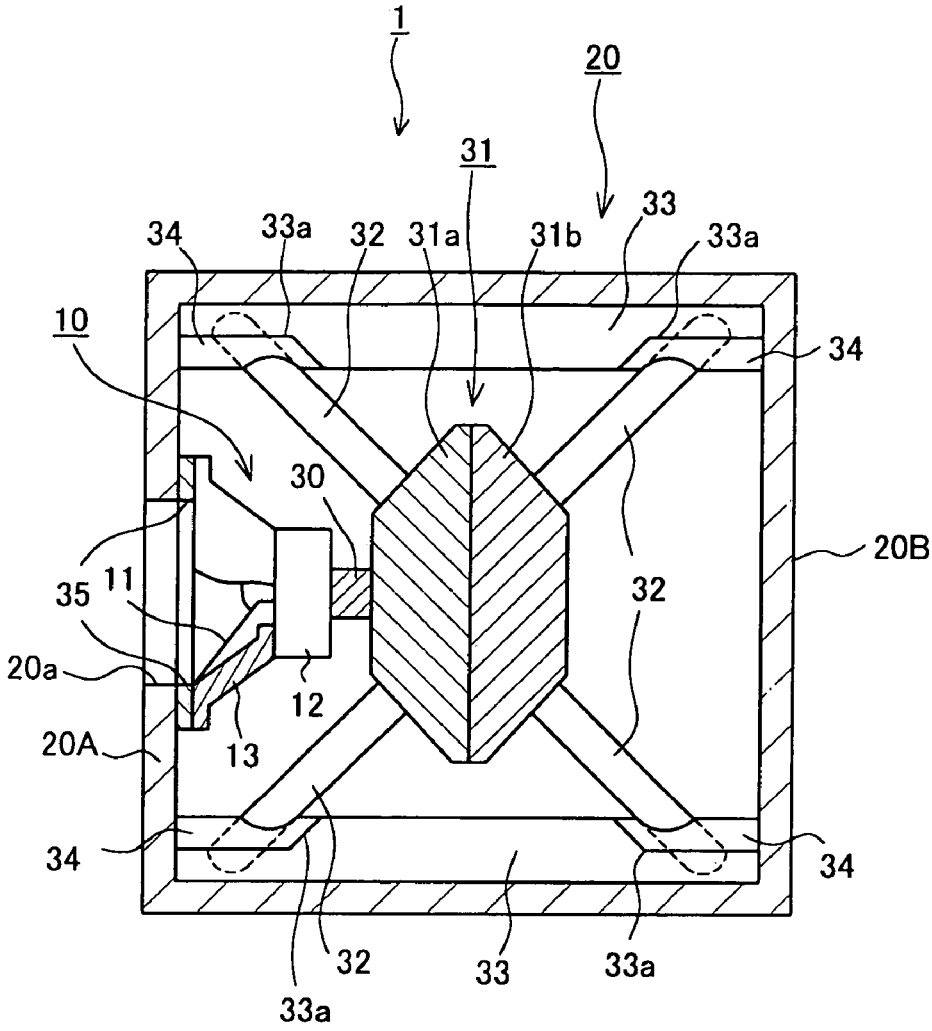
FIG. 2 is a sectional view along line II-II of FIG. 1.

The preferred embodiments of the support structure of a loudspeaker unit and the loudspeaker system according to the present invention are described below with reference to the drawings. FIG. 1 is a partly sectional perspective view schematically showing a loudspeaker system in which a support structure of a loudspeaker unit according to a first embodiment is adopted, and FIG. 2 is a sectional view along line II-II of FIG. 1.

Reference numeral 10 in FIG. 1 represents a loudspeaker unit, and reference numeral 20 therein represents a cabinet having an opening 20*a* (FIG. 2) in which the front portion of the loudspeaker unit 10 is located.

The loudspeaker unit 10 comprises a cone 11 which is a diaphragm, a voice coil (not shown) and a magnetic circuit 12 for generating a driving force for vibrating the cone 11, a frame 13 which couples the above elements to each other, and associated parts. The magnetic circuit 12 comprises a plate, a magnet, a yoke and associated parts (none of them shown).

An anchor 31 functioning as a weight is connected through a columnar metallic adaptor 30 to the backside (the magnetic circuit 12 side) of the loudspeaker unit 10. External threads (not shown) are cut at both ends of the adaptor 30, and the external threads are screwed into internal threads (not shown) arranged on the magnetic circuit 12 and the anchor 31, respectively, so as to fasten the loudspeaker unit 10, adaptor 30 and anchor 31. Here, the method for fastening only needs to reliably fasten loudspeaker unit 10, adaptor 30 and anchor 31, and any other methods, besides the method using screws, may be safely adopted.

The anchor 31 comprises two anchor members 31*a* and 31*b* which are almost in the shapes of truncated cones, and are made of a metal such as iron. In each of the anchor members 31*a* and 31*b*, the same screw hole (not shown) is formed at the same place, and the anchor members 31*a* and 31*b* are coupled by using screws. In order to allow the anchor 31 to function as a virtual ground, the weight of the anchor 31 is set to be heavier than the weight of the loudspeaker unit 10 (e.g. about 2-3 times heavier than the loudspeaker unit 10). Thus, vibrations transmitted from the loudspeaker unit 10 are suppressed in the anchor 31.

Four columnar metallic supports 32 are arranged radially toward four front side corners of the cabinet 20 from a sloped portion of the anchor member 31*a*. An external thread (not shown) is cut at one end of each support 32 on its connected side to the anchor member 31*a*, and is screwed into an internal thread (not shown) arranged in the anchor member 31*a* so as to be fixed to the anchor member 31*a*.

Furthermore, four columnar metallic supports 32 are arranged radially toward four backside corners of the cabinet 20 from a sloped portion of the anchor member 31*b*. An external thread (not shown) is cut at one end of each support 32 on its connected side to the anchor member 31*b*, and is screwed into an internal thread (not shown) arranged in the anchor member 31*b* so as to be fixed to the anchor member 31*b*.

The other end of each of the radially arranged supports 32 is fitted in each fitting portion 33*a* of positioning members 33 fixed in four corners in the direction of the length (the direction from the front side to the backside) of the cabinet 20, respectively. A cushioning member 34 is fitted between the other end of each of these supports 32 and each fitting portion 33*a* of the positioning members 33. The cushioning member 34 only needs to have a cushioning feature and be of a material that is excellent in vibration absorbency. For example, felt, plastic foam, nonwoven fabric or the like can be used as the material of the cushioning member.

Since the tip portions of the supports 32 supporting the anchor 31 are fastened to the positioning members 33 through the cushioning members 34, the loudspeaker unit 10 is held in a floating state relative to the cabinet 20. And since the anchor 31 to which the loudspeaker unit 10 is connected is supported by multiple (eight in this case) radially arranged supports 32, the arranged position of the loudspeaker unit 10 is not varied even if the cabinet 20 is caused to tilt or topple over, so that the stable construction can be maintained.

A ring-shaped cushioning member 35 is fitted between the overall outer region of the frame 13 of the loudspeaker unit 10 and the front of the cabinet 20. As the cushioning member 35, a material having the same quality as the cushioning member 34 can be used, but the use of a material that is excellent in airtightness is preferable. With the cushioning member 35, the airtight state inside the cabinet 20 is maintained, and the loudspeaker unit 10 is held in a floating state relative to the front of the cabinet 20.

An example of a method for assembling a loudspeaker system 1 according to the first embodiment is described below.

An assembled member A is constituted by the anchor member 31*a* fastened to the adaptor 30, loudspeaker unit 10 and four supports 32, an assembled member B is constituted by the anchor member 31*b* fastened to the four supports 32, and the cabinet 20 (without a front panel 20A and a backside panel 20B attached thereto) has the positioning members 33 fixed at prescribed places (in this case, four corners in the direction of the length).

The assembled member B is put into the cabinet 20 from the backside thereof, and the tip portion of each of the supports 32 is fitted through the cushioning member 34 into each fitting portion 33*a* of the positioning members 33. As necessary, in order to prevent the tip portions of the supports 32 from coming off the fitting portions 33*a*, the tip portions of the supports 32 are pressed through the cushioning members 34 with wedge-shaped wood pieces (not shown) or the like.

Then, the assembled member A is put into the cabinet 20 from the front side thereof, the tip portion of each of the supports 32 is fitted through the cushioning member 34 into each fitting portion 33*a* of the positioning members 33, and the anchor members 31*a* and 31*b* are coupled to each other using screws.

The wood pieces are thereafter removed, predetermined wiring to the loudspeaker unit 10 is installed, and finally, the backside panel 20B and the front panel 20A having the opening 20*a* to which the cushioning member 35 is fitted are attached to the cabinet 20. Thus, the loudspeaker system 1 according to the first embodiment can be assembled.

In the loudspeaker system 1 in which the support structure of a loudspeaker unit according to the first embodiment is adopted, the tip of each of the supports 32 is held in the positioning member 33, the anchor 31 is supported by the supports 32 whose tips are held inside the cabinet 20, and the cushioning member 34 is fitted between the tip portion of the support 32 and the positioning member 33. Therefore, the loudspeaker 10 connected to the anchor 31 is held in a floating state in a prescribed position within the cabinet 20. As a result, since vibrations transmitted from the loudspeaker unit 10 to the anchor 31 are not transmitted to the cabinet 20, it is possible to prevent degradation of the quality of sound (such as unclearness of sound) caused by undesired vibrations of the cabinet 20.

Setting the weight of the anchor 31 to be heavier than the weight of the loudspeaker unit 10 enables the anchor 31 to function as a virtual ground. As a result, the effect of suppressing the vibrations of the loudspeaker unit 10 can be further enhanced.

Furthermore, even if the installed condition of the cabinet 20 is changed (for example, even if tilting, toppling or the like occurs), the anchor 31 is stably supported by the supports 32. Therefore, the mounted condition of the loudspeaker unit 10 is not changed, resulting in a construction having excellent stability in the mounted condition. Further, the orientation of installation, such as a portrait or landscape orientation, can be freely changed, and the structure is easily applied to not only loudspeaker systems for home use but also those for vehicles or the like.

Since the anchor 31 comprises the anchor members 31*a* and 31*b*, the anchor members 31*a* and 31*b* can be separately assembled into the cabinet 20 and thereafter be coupled to each other using screws. As a result, the process of the assembling of the anchor 31 into the cabinet 20 is easy to carry out and the workability of the assembling process is desirable.

With the multiple supports 32 radially arranged from the anchor 31, the anchor 31 is stably supported through the interaction of the multiple supports 32, even if the installed condition of the cabinet 20 is changed because of tilting, toppling or the like. Therefore, the occurrence of a position change of the anchor 31 can be prevented, so that the loudspeaker unit 10 connected to the anchor 31 can be supported in its stable state within the cabinet 20.

By fitting the tip portions of the supports 32 into the fitting portions 33*a*, it is possible to prevent displacements of the tip portions of the supports 32 caused by tilting or toppling of the cabinet 20, shakes in transmit or the like, so that the loudspeaker unit 10 connected to the anchor 31 can be stably held within the cabinet 20.

With the cushioning member 35, the airtight state inside the cabinet 20 can be maintained and the loudspeaker unit 10 is allowed to come in contact with the front panel 20A of the cabinet 20 in its floating state, so that it is possible to prevent transmission of vibrations from the loudspeaker unit 10 to the front of the cabinet 20, thereby preventing degradation of the quality of sound caused by undesired vibrations of the cabinet 20.

In the above-described first embodiment, the cushioning members 34 are fitted between the tip portions of the supports 32 and the fitting portions 33*a* of the positioning members 33, but in another embodiment, the cushioning members 34 may be fitted between the anchor members 31*a* and 31*b*, and the supports 32, respectively. In this case, holes are formed in the anchor members 31*a* and 31*b*, with each hole being large enough to accommodate one end of each support 32 to be fitted in through the cushioning member 34.

In the above-described first embodiment, a case where the supports 32 are almost radially arranged toward each corner of the cabinet 20 from the anchor 31 was described, but as for the arrangement form of the supports 32 being supporting members, various forms can be adopted as long as the anchor 31 can be stably held inside the cabinet 20 thereby, and according to the arrangement forms of the supports 32, the shape of the positioning members 33 or the mounted positions thereof may be modified as necessary.

Alternatively, fitting portions into which the tip portions of the supports 32 would be fitted may be formed on the cabinet 20 itself so that the cabinet 20 is allowed to perform a function of the positioning member 33.

Figure 3:
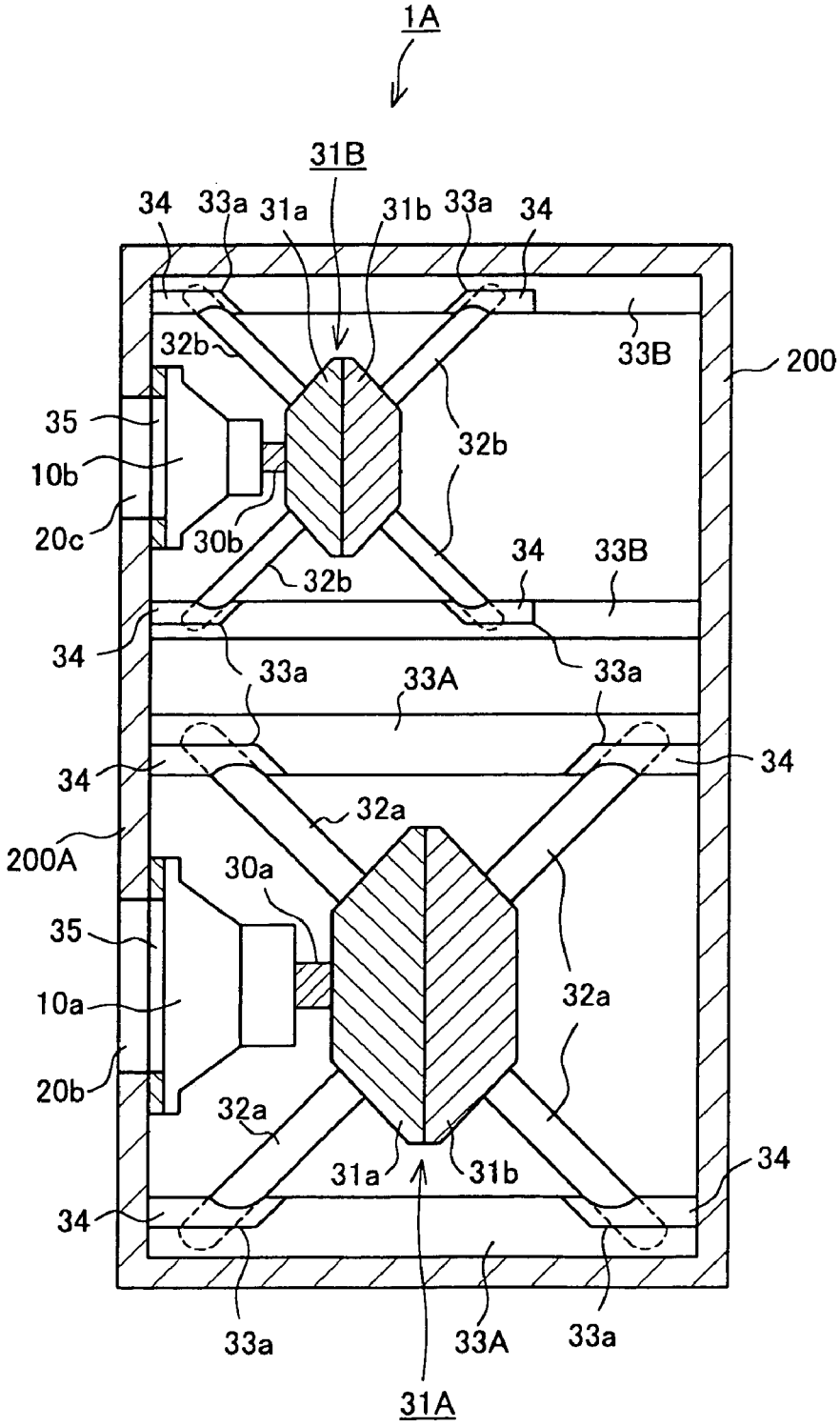
FIG. 3 is a sectional side view schematically showing a loudspeaker system in which two sets, large and small, of the support structure of a loudspeaker unit according to the first embodiment are adopted in one loudspeaker cabinet.

FIG. 3 is a sectional side view showing a loudspeaker system in which two sets, large and small, of the support structure of a loudspeaker unit according to the above first embodiment are adopted within one cabinet. Here, the components having the same functions as those of the loudspeaker system 1 shown in FIG. 1 are similarly denoted with the same reference numerals and are not further described below.

An opening 20*b* is arranged in the front lower portion of a cabinet 200 which is almost in the shape of a rectangular parallelepiped. A loudspeaker unit 10*a* is held in a floating state relative to the cabinet 200 by an anchor 31A having an adaptor 30*a*, supports 32*a*, positioning members 33A on which cushioning members 34 are placed and a cushioning member 35, and is supported by the structure being strong against tilting or toppling and stable in its assembled condition.

An opening 20C is arranged in the upper portion of the front panel 200A of the cabinet 200. A loudspeaker unit 10*b* smaller than the loudspeaker unit 10*a* is held in a floating state relative to the cabinet 200 by an anchor 31B having an adaptor 30*b*, supports 32*b*, positioning members 33B on which cushioning members 34 are placed and a cushioning member 35, and is supported by the structure being strong against tilting or toppling and stable in its assembled condition.

Here, in this case, the positioning members 33A of the loudspeaker unit 10*a* and the positioning members 33B of the loudspeaker unit 10*b*, both being arranged around the middle height of the cabinet 200, are bonded or fastened with screws or the like to the sidewalls of the cabinet 200.

Thus, the support structure of a loudspeaker unit according to the above first embodiment is adaptable to the two-way loudspeaker system in which two loudspeaker units 10*a* and 10*b* are arranged in one cabinet 200. By holding each of the loudspeaker units 10*a* and 10*b* in a floating state, degradation of the quality of output sound can be prevented. Further, the system can be given a stable construction in which no displacement or the like of the loudspeaker units 10*a* and 10*b* is caused even by tilting, toppling or the like.

Figure 4:
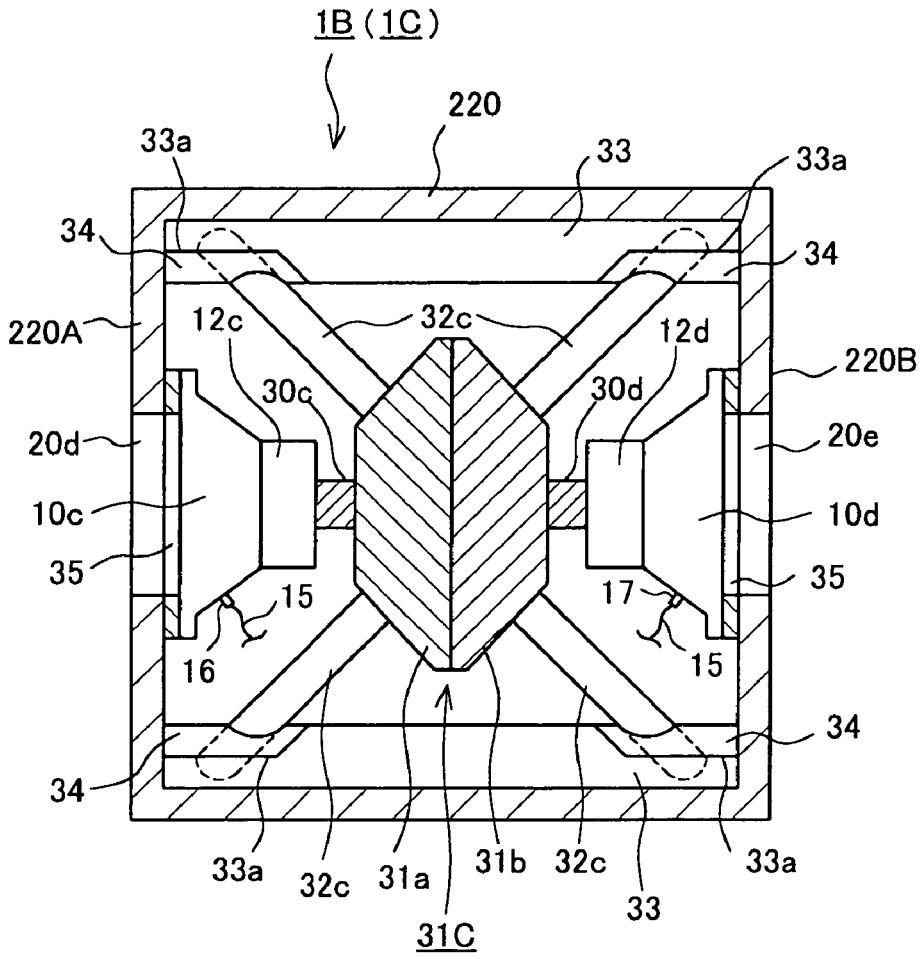
FIG. 4 is a sectional side view schematically showing a loudspeaker system in which a support structure of a loudspeaker unit according to a second embodiment is adopted.
Figure 5:
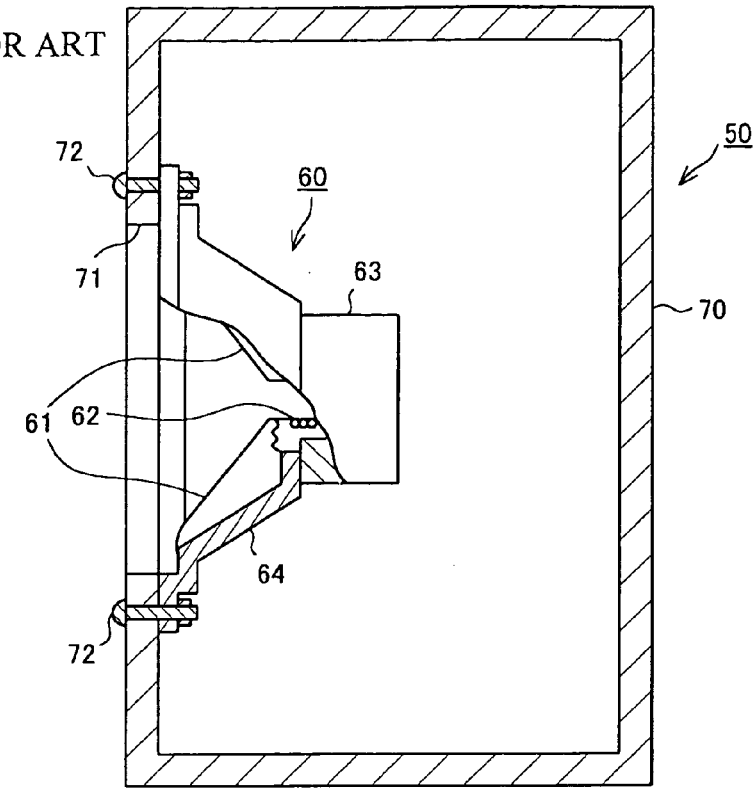
Fig.5 PRIOR ART
FIG. 5 is a sectional side view schematically showing a conventional loudspeaker system.
Figure 6:
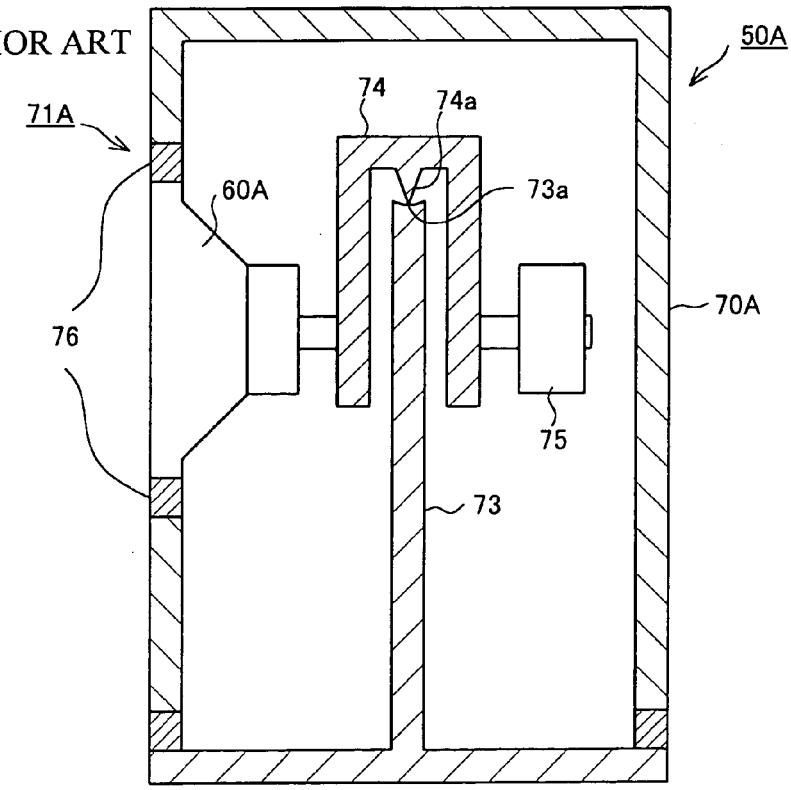
Fig.6 PRIOR ART
FIG. 6 is a sectional side view schematically showing another conventional loudspeaker system.

FIG. 4 is a sectional side view schematically showing a loudspeaker system according to a second embodiment. Here, since the construction of the loudspeaker system according to the second embodiment is almost the same as that of the loudspeaker system 1 shown in FIG. 1 except that two loudspeaker units 10*c* and 10*d* are connected to each other in back-to-back positions through an anchor 31C having adaptors 30*c* and 30*d*, the components having the same functions are similarly denoted with the same reference numerals and are not further described below.

Reference numerals 10*c* and 10*d* in FIG. 4 represent loudspeaker units, and reference numeral 220 therein represents a cabinet having openings 20*d* and 20*e* in which the front portions of the loudspeaker units 10*c* and 10*d* are located, respectively. Here, it is most preferable that the loudspeaker units 10*c* and 10*d* have the same construction and the same shape, but it is essential only that the loudspeaker units 10*c* and 10*d* have at least cones (not shown) having the same radius and magnetic circuits 12*c* and 12*d* having the same radius, respectively.

The loudspeaker unit 10*c* is connected through the adaptor 30*c* to the anchor member 31*a*, while the loudspeaker unit 10*d* is connected through the adaptor 30*d* of the same size as the adaptor 30*c* to the anchor member 31*b*. The loudspeaker units 10*c* and 10*d* are symmetrically arranged through the adaptor 30*c* and the anchor 31*a*, and the adaptor 30*d* and the anchor 31*b*. And another cushioning member 35 is fitted between the loudspeaker unit 10*d* and the backside panel 220B of the cabinet 220.

Audio signals go by way of an input terminal (not shown) arranged on the cabinet 220, connecting lines 15, and terminals 16 and 17, and are supplied to the loudspeaker units 10*c* and 10*d*, respectively. In this case, the audio signals supplied to the loudspeaker units 10*c* and 10*d* are signals in phase with each other, which allow the loudspeaker units 10*c* and 10*d* to generate the same sound at the same time.

By thus supplying the signals in phase to the loudspeaker units 10*c* and 10*d*, vibrations transmitted to the magnetic circuits 12*c* and 12*d* from each cone of the loudspeaker units 10*c* and 10*d* are canceled out in the anchor 31C, resulting in a much higher effect of suppressing vibrations.

The loudspeaker system 1B having the above construction can be assembled in the same manner as the assembling method described in the loudspeaker system 1 according to the above first embodiment.

In the loudspeaker system 1B according to the above second embodiment, since the loudspeaker units 10*c* and 10*d* connected back to back to each other through the anchor 31C are operated in phase with each other, the vibrations transmitted from both the loudspeaker units 10*c* and 10*d* are canceled out in the anchor 31C, so that the effect of suppressing the vibrations transmitted from the loudspeaker units 10*c* and 10*d* can be further enhanced.

A loudspeaker system according to a third embodiment is described below. Here, since the construction of the loudspeaker system according to the third embodiment is the same as that of the loudspeaker system 1B shown in FIG. 4 except that audio signals supplied to each loudspeaker unit are out of phase, the components having the same functions are similarly denoted with the same reference numerals and are not further described below.

In the loudspeaker system 1B according to the second embodiment, the same signals are supplied in phase to the loudspeaker units 10*c* and 10*d* each, but in the loudspeaker system 1C according to the third embodiment, the same signals are supplied in opposite phase to the loudspeaker units 10*c* and 10*d*, respectively.

In the loudspeaker system 1C, in order to supply the same signals in opposite phase, the loudspeaker units 10*c* and 10*d* are wired to each input terminal (not shown) so that speaker output terminals of an amplifier (not shown) from which audio signals are output to the loudspeaker units 10*c* and 10*d*, respectively, become opposite in polarity (+ and −).

In the loudspeaker system 1C according to the third embodiment, the loudspeaker units 10*c* and 10*d* are symmetrically connected back to back to each other through the anchor 31C. Since the same signals are supplied in opposite phase to the loudspeaker units 10*c* and 10*d*, the loudspeaker units 10*c* and 10*d* are operated in opposite phase to each other, resulting in a construction wherein no change in pressure inside the cabinet 220 is apparently brought about. As a result, because of no effect of variations in internal pressure, it is possible to make the response characteristics of the cones of the loudspeaker units 10*c* and 10*d* better, the quality of sound can be further enhanced and the cabinet 220 can be made smaller.

What is claimed is:

1. A support structure of a loudspeaker unit, comprising:

a loudspeaker cabinet having an opening at which a front side of a loudspeaker unit is to be located;

an anchor member to be connected to a backside of the loudspeaker unit;

a supporting member arranged to support said anchor member inside said loudspeaker cabinet;

a positioning member configured to position said supporting member in said loudspeaker cabinet; and a cushioning member fitted between said supporting member and at least one of said positioning member and said anchor member;

wherein the loudspeaker unit is fastened to said loudspeaker cabinet through said anchor member, said supporting member and said cushioning member.

2. A support structure of a loudspeaker unit, according to claim 1, wherein said anchor member comprises a first anchor member and a second anchor member, said first anchor member and said second anchor member being coupled.

3. A support structure of a loudspeaker unit, according to claim 1, wherein said supporting member comprises multiple supports radially arranged from said anchor member.

4. A support structure of a loudspeaker unit, according to claim 1, wherein said positioning member has a fitting portion into which a tip portion of said supporting member is fitted.

5. A support structure of a loudspeaker unit, according to claim 1, wherein a cushioning member is mounted at said opening of said loudspeaker cabinet to be fitted between said opening of said loudspeaker cabinet and the loudspeaker unit.

6. A loudspeaker system, wherein multiple sets of said support structure according to claim 1 are arranged within said loudspeaker cabinet.

7. A loudspeaker system, wherein the support structure of a loudspeaker unit according to claim 1 is adopted, comprising:

a first loudspeaker unit and a second loudspeaker unit connected back to back through said anchor member, said first loudspeaker unit and said second loudspeaker unit being configured to receive the same signals in phase with each other.

8. A loudspeaker system, wherein the support structure of a loudspeaker unit according to claim 1 is adopted, comprising:

a first loudspeaker unit and a second loudspeaker unit connected back to back through said anchor member, the said loudspeaker unit and said second loudspeaker unit being configured to receive the same signals in opposite phase to each other.

9. A support structure of a loudspeaker unit, according to claim 1, wherein said supporting member comprises at least one support rod.

10. A support structure of a loudspeaker unit, according to claim 1, wherein said opening is formed in a front wall of said loudspeaker cabinet;

said supporting member extends between said anchor member and a first side wall of said loudspeaker cabinet.

11. A support structure of a loudspeaker unit, according to claim 10, wherein said loudspeaker cabinet has a rectangular parallelepiped construction including said front wall, a rear wall, and a plurality of side walls including said first side wall.

12. A support structure of a loudspeaker unit, according to claim 1, wherein said anchor member is heavier in weight than the loudspeaker unit.

13. A support structure of a loudspeaker unit, comprising:

a loudspeaker cabinet having an opening at which a front side of the loudspeaker unit is to be located;

an anchor member to be connected to a backside of the loudspeaker unit;

a supporting member arranged to support said anchor member inside said loudspeaker cabinet;

a positioning member configured to position said supporting member in said loudspeaker cabinet; and a cushioning member fitted between said supporting member and at least one of said positioning member and said anchor member;

wherein said supporting member comprises multiple supports radially arranged from said anchor member.

14. A support structure of a loudspeaker unit, according to claim 13, wherein said anchor member comprises a first anchor member and a second anchor member, said first anchor member and said second anchor member being coupled.

15. A support structure of a loudspeaker unit, according to claim 13, wherein said positioning member has a fitting portion into which a tip portion of said supporting member is fitted.

16. A support structure of a loudspeaker unit, according to claim 13, wherein a cushioning member is mounted at said opening of said loudspeaker cabinet to be fitted between said opening of said loudspeaker cabinet and the loudspeaker unit.

17. A loudspeaker system, wherein multiple sets of said support structure according to claim 13 are arranged within said loudspeaker cabinet.

18. A support structure of a loudspeaker unit, according to claim 13, wherein said multiple supports comprise support rods.

19. A loudspeaker system comprising:

a first loudspeaker unit and a second loudspeaker unit configured to receive the same signals in phase with each other;

a loudspeaker cabinet having first and second openings at which front sides of said first and second loudspeaker units are located;

an anchor member connected to backsides of said first and second loudspeaker units such that said first and second loudspeaker units are connected back to back through said anchor member;

a supporting member arranged to support said anchor member inside said loudspeaker cabinet;

a positioning member configured to position said supporting member in said loudspeaker cabinet; and a cushioning member fitted between said supporting member and at least one of said positioning member and said anchor member.

20. A loudspeaker system comprising:

a first loudspeaker unit and a second loudspeaker unit configured to receive the same signals in opposite phase to each other;

a loudspeaker cabinet having first and second openings at which front sides of said first and second loudspeaker units are located;

an anchor member connected to backsides of said first and second loudspeaker units such that said first and second loudspeaker units are connected back to back through said anchor member;

a supporting member arranged to support said anchor member inside said loudspeaker cabinet;

a positioning member configured to position said supporting member in said loudspeaker cabinet; and a cushioning member fitted between said supporting member and at least one of said positioning member and said anchor member.

* * * * *